US007316196B2

(12) United States Patent
Haas

(10) Patent No.: US 7,316,196 B2
(45) Date of Patent: Jan. 8, 2008

(54) METHOD AND APPARATUS FOR HANDLING MOORING LINES

(75) Inventor: Mark Edward Haas, Houston, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 11/377,540

(22) Filed: Mar. 16, 2006

(65) Prior Publication Data

US 2006/0207488 A1 Sep. 21, 2006

Related U.S. Application Data

(60) Provisional application No. 60/663,400, filed on Mar. 18, 2005.

(51) Int. Cl.
*B63B 21/24* (2006.01)

(52) U.S. Cl. ..... 114/293; 367/107

(58) Field of Classification Search ..... 114/267, 114/293, 297; 367/104, 106, 107
See application file for complete search history.

(56) References Cited

U.S. PATENT DOCUMENTS

| | | | | |
|---|---|---|---|---|
| 3,810,081 | A * | 5/1974 | Rininger | 367/107 |
| 3,927,636 | A | 12/1975 | Childers et al. | 114/206 |
| 4,098,216 | A | 7/1978 | Bruce | 114/297 |
| 4,164,379 | A * | 8/1979 | Denman | 367/106 |
| 4,610,007 | A | 9/1986 | Bannell et al. | 367/104 |
| 4,912,464 | A * | 3/1990 | Bachman | 114/293 |
| 5,970,901 | A | 10/1999 | Bruce | 114/293 |
| 2002/0116115 | A1 | 8/2002 | Lin | 701/214 |
| 2002/0116125 | A1 | 8/2002 | Fang | |

FOREIGN PATENT DOCUMENTS

| | | |
|---|---|---|
| JP | 9061166 | 7/1997 |
| WO | WO0073815 A1 | 7/2000 |
| WO | WO03036233 A1 | 1/2003 |

OTHER PUBLICATIONS

TH2798 PCT. PCT/US2006/009994. International Search Report. dated Jul. 14, 2006.
TH2798 PCT. PCT/US2006/009994. Written Report dated Jul. 14, 2006.

* cited by examiner

*Primary Examiner*—Lars A. Olson
(74) *Attorney, Agent, or Firm*—William E. Hickman

(57) ABSTRACT

Apparatus and methods of monitoring mooring lines of an offshore drilling rig, with the apparatus including a communication system in communication with a global positioning system, providing position coordinates of the apparatus at a first point on the line, and also includes an inertial navigation system supported by the frame, providing position coordinates of the apparatus at a second point on the line, by double integration with respect to time of inertial accelerations measured by the device as it is moved from the first point to the second point. Correction at the second point is provided by obtaining at the second point, depth, position relative to magnetic north, and deviation from vertical.

14 Claims, 2 Drawing Sheets

METHOD AND APPARATUS FOR HANDLING MOORING LINES

CROSS-REFERENCE TO RELATED APPLICATION

This application claims priority to U.S. Provisional Application 60/663,400 filed on Mar. 18, 2005, herein incorporated by reference in its entirety.

FIELD OF THE INVENTION

The present invention relates to apparatus, and methods for drilling wells. In another aspect, the present invention relates to apparatus, and methods for drilling offshore wells. In even another aspect, the present invention relates to apparatus, and methods for moving a drilling apparatus to a new position. In still another aspect, the present invention relates to apparatus, and methods for tracking and/or determining the underwater position of any lines/cables extending from an offshore apparatus.

DESCRIPTION OF THE RELATED ART

The search for hydrocarbons may lead to offshore areas, where drilling, especially in deeper waters, can be quite complicated, difficult and expensive.

Locating oil in deep water requires the use of large and expensive drilling rigs. These rigs can be drill ships, barges, tension leg platforms (TLPs), spars, or semi-submersibles, any of which can be referred to as a drilling apparatus.

Operation of such drilling apparatus can be quite complicated especially when moving the drilling apparatus after it has been anchored, that is, repositioning it about its established or installed pattern of mooring lines. Such repositioning is preferable or necessary to drill another well in a different or at an offset location.

An offshore drilling apparatus may be relocated over different well patterns or locations by employing anchor-handling vessels.

Such vessels would mobilize to the site of the installed drilling apparatus to recover and then reposition the mooring anchors and, by default, the mooring lines to allow the drilling apparatus to drill additional wells at different locations within the prescribed drilling area, field, or lease. Because of the time involved and the involvement of such vessels, the described operation could costs from several hundreds of thousands dollars to a few million dollars depending upon a number of factors.

Alternatively, the installed mooring lines may be alternately lengthened and shortened so that the drilling apparatus is offset to a new location within the field or drilling lease. This method saves the time and expense associated with the mobilization of the anchor-handling vessels.

Sometimes the mobilization of the anchor-handling vessels would literally lift the anchor and its attached mooring line free and clear of the seafloor and its soils and then reset the anchor in a new prescribed location. Alternatively, the drilling vessel may be relocated within the field by adjusting the tension (by lengthening or shortening) within the mooring lines so that the drilling apparatus find its new equilibrium over its newly-prescribed relocation. The mooring lines are not cleared of the seafloor and the mooring wire, chain, and anchor are left to bury themselves into the seafloor soils. As the drilling apparatus is moved, the different components can absorb and distribute the mooring tension in a different manner than having the anchor as the primary, but not sole, component to distribute tension into the seafloor soils. As such with this method, the distribution of the mooring tension does not necessarily have to occur in a straight line, as would occur with the anchor being set first into the soils, and the mooring wire and chain can settle into a pattern that is snaked through the seafloor soils. While the drilling apparatus is properly positioned over the its new location, the problem with having the mooring line assume an unknown distribution pattern through the seafloor soils can become apparent during the final retrieval of the mooring line in preparation for mobilization of the drilling apparatus to a different field. The biggest problem is that through one or more repetitions of tightening and loosening of the mooring lines, the location of the lines can become lost or displaced. The line is not lost in the sense that it cannot be retrieved, because the other end is affixed the drilling apparatus, but rather lost in that the exact location of the mooring line between the drilling apparatus and the anchor as it transits through the mud may not be known. During one retrieval operation, the mooring line of a drilling apparatus operated by a major oil company became entangled with and damaged seafloor installed oilfield equipment. Estimates for the repair and replacement of the damaged equipment exceeded 25 million US dollars.

Understandably, because of the cost savings of moving the drilling apparatus thru the tightening or loosening of the mooring lines, there have been attempts to improve the method, with an emphasis on tracking or monitoring the location of the mooring line from the drilling apparatus to the anchored end.

As in known to those of skill in the art, a "horse collar" attached to the PCC (Permanent Chain Chaser) cable, and straddles the mooring line. The PCC cable is a leader line that is led between the horse collar and the lifting line on the anchor-handling vessel. The horse collar, as a part of the PCC cable, is towed by an anchor handling vessel from the drilling rig along the mooring line to the anchor. When the horse collar and the cable chaser reach the end of the mooring line punctuated by the anchor, then the anchor lift line, the PCC cable, the horse collar, and the cable chaser are hoisted or winched by the anchor-handling vessel to raise the anchor and mooring line from the seafloor to allow relocation.

One idea is to implement a transponder-based system attached to the horse collar at the end of the PCC cable. By its attachment to the horse collar, the transponder is exposed to the abuse of transiting through the mud. Another consequence of transiting through the mud is that the mud and any entrapped gasses would inhibit the transmission of the acoustic signal from the transponder. Transponder-based systems may also require that a transceiver be rigidly affixed to either the drilling apparatus or the anchor-handling vessel. Also, the computer system for the transceiver/transponder requires significant and continuous navigational input from the vessel to which the transceiver is rigidly affixed.

There is a need in the art of offshore drilling for improved apparatus, products, and methods for use in repositioning an offshore drilling apparatus.

There is another need in the art of offshore drilling for apparatus, products, and methods for use in repositioning an offshore drilling apparatus, which can overcome one or more of the deficiencies listed above.

These and other needs of the present invention will become apparent to those of skill in the art upon review of this specification, including its drawings and claims.

SUMMARY OF THE INVENTION

It is an object of the present invention to provide for improved apparatus, products, and methods for use in repositioning an offshore drilling apparatus.

It is another object of the present invention to provide for apparatus, products, and methods for use in repositioning an offshore drilling apparatus, which can overcome one or more of the deficiencies listed above.

These and other objects of the present invention will become apparent to those of skill in the art upon review of this specification, including its drawings and claims.

According to one embodiment of the present invention, there is provided a method for monitoring a line, with a first end extending from a floating marine structure and the second end in a body of water. The method includes positioning a monitoring device at a first point on the line and determining position coordinates of the first point on the line. The method may also include moving a monitoring device along the line from the first point to a second point on the line, and then determining position coordinates of the second point on the line. In a further embodiment of this embodiment, position coordinates of the second point may be obtained by double integrating with respect to time of inertial accelerations measured by the device as it is moved from the first point to the second point. In even a further embodiment of this embodiment, an error correction for the second point may be obtained by determining at least one of, preferably all three, of (1) the depth of the device at the second point, (2) the position of the device at the second point relative to magnetic north, and (3) the deviation of the device from vertical.

According to another embodiment of the present invention, there is provided a method for relocating a mooring line with a first end extending from a floating marine structure and the second end in a body of water. The method may include positioning a monitoring device at a first point on the line, and determining position coordinates of the first point on the line. The method may also include moving a monitoring device along the line from the first point to a second point on the line, and then determining position coordinates of the second point on the line. Knowing the position of the points allows relocation of the mooring line with traverse of known obstacles. In a further embodiment of this embodiment, position coordinates of the second point may be obtained by double integrating with respect to time of inertial accelerations measured by the device as it is moved from the first point to the second point. In even a further embodiment of this embodiment, an error correction for the second point may be obtained by determining at least one, preferably all three, of (1) the depth of the device at the second point, (2) the position of the device at the second point relative to magnetic north, and (3) the deviation of the device from vertical.

According to even another embodiment of the present invention, there is provided an apparatus for monitoring a line, the line comprising a first end extending from a floating marine structure and the second end in a body of water. The apparatus generally includes a communication system in communication with a global positioning system, providing position coordinates of the apparatus at a first point on the line. The apparatus also includes an inertial navigation system supported by the frame, providing position coordinates of the apparatus at a second point on the line, by double integration with respect to time of inertial accelerations measured by the device as it is moved from the first point to the second point. In a further embodiment, the apparatus may also include a correction measurement device, comprising at least one device, preferably three, selected from the group of devices consisting of a pressure gage apparatus providing a depth, a compass apparatus providing a direction relative to magnetic north, and an inclinometer apparatus for providing deviation from vertical, wherein the device may be supported by the frame. In even a further embodiment, the apparatus may also include an error correction module in communication with the error correction device, which generates an error correction for the position coordinates of the apparatus at a second point on the line.

According to still another embodiment of the present invention, there is provided method of positioning a floating marine structure, that incorporates one or more of the above method steps into known methods of positioning a floating marine structure, especially as the methods relate to monitoring and positioning lines. For example, known methods of positioning a drilling rig generally include moving mooring cables as part of the method of moving the rig. One or more of the steps of the above methods can be incorporated into monitoring the mooring cables, and then positioning them.

According to yet another embodiment of the present invention, there is provided method of positioning a floating marine structure, that incorporates one or more of the above method steps into known methods of drilling utilizing a floating drilling structure, especially as the methods relate to monitoring and positioning lines. For example, known methods of drilling include positioning a drilling rig, which generally includes moving mooring cables as part of the method of moving the rig. One or more of the steps of the above methods can be incorporated into monitoring the mooring cables, and then positioning them.

According to even still another embodiment of the present invention, there is provided a positionable floating marine structure, having part or all of the above describe apparatus incorporated therein. Specifically, the above apparatus for monitoring a line can be incorporated into any positionable floating marine structure.

These and other embodiments of the present invention will become apparent to those of skill in the art upon review of this specification, including its drawings and claims.

DETAILED DESCRIPTION OF THE INVENTION

The present invention provides methods and apparatuses for establishing and/or tracking the location of mooring lines of an offshore drilling apparatus.

Figure 1:
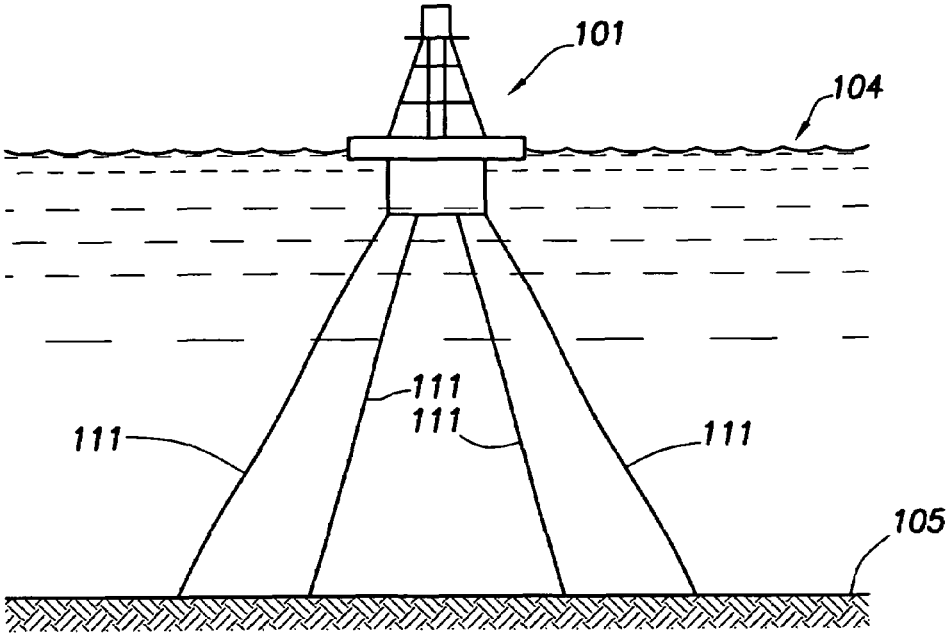
FIG. 1, shows a schematic illustration of a typical offshore structure 101, such as a drilling platform, ocean surface 104, plurality of mooring lines 111 extending to ocean bottom 105.

Referring first to FIG. 1, there is shown a schematic illustration of a typical offshore drilling platform 101, ocean surface 104, plurality of mooring lines 111 extending to ocean bottom 105. While the present invention will generally be illustrated by reference to an "ocean," as used herein, ocean refers to any body of water with "ocean bottom" referring to the bottom of the body of water, non-limiting examples of which include gulf, bay, lake, sea, ocean, strait, sound, channel, stream, or river.

Figure 2:
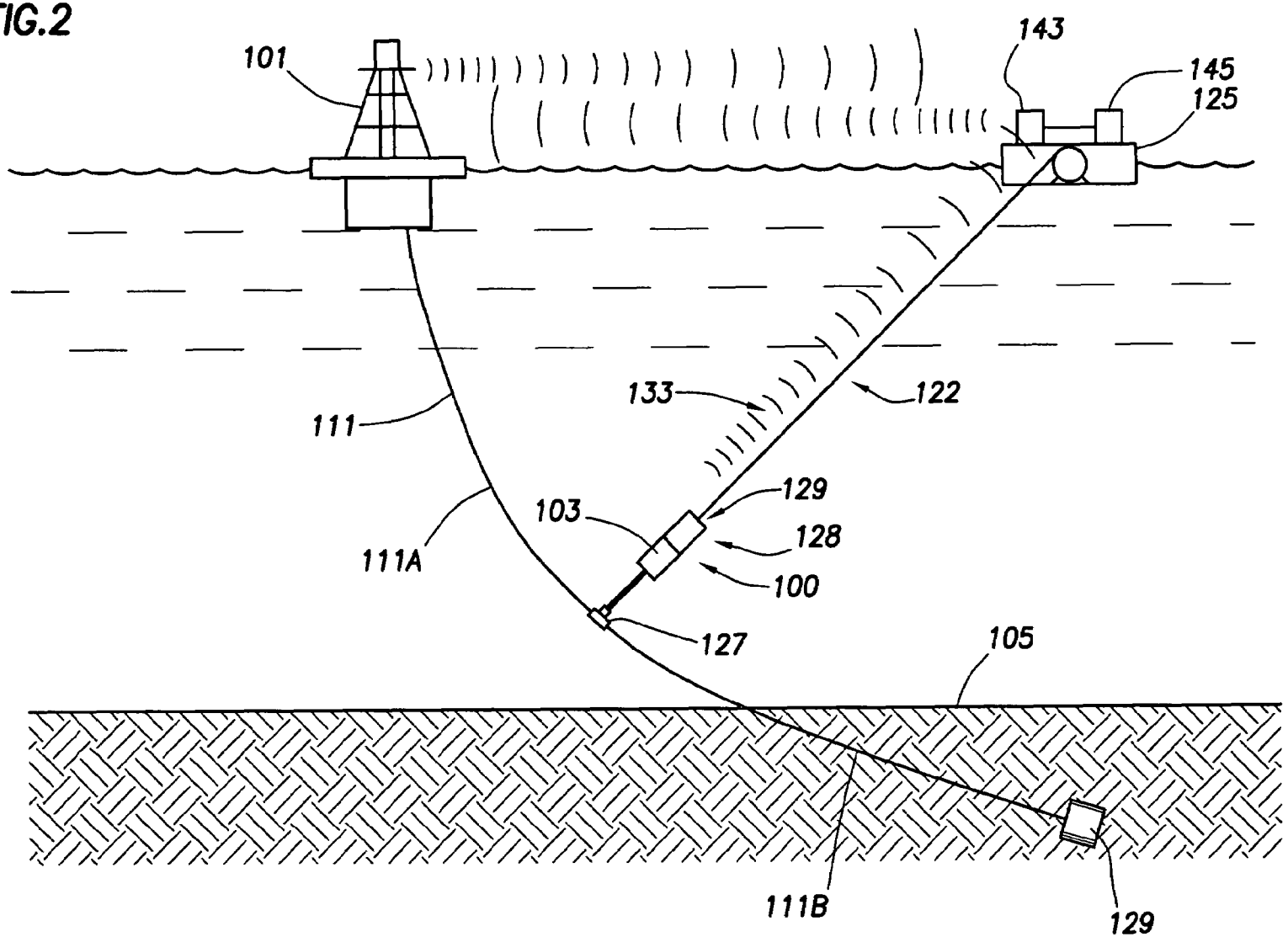
FIG. 2, shows a schematic illustration of mooring line 111 extending from platform 101, with mooring line portion 111A extending thru the ocean, with mooring line portion 111B and anchor 129 buried in ocean bottom 105, with lifting line 122 extending from anchor handling vessel 125 and connected to mooring line 111 via PCC lead line 128 and horse collar 127.

Referring now to FIG. 2, there is shown a schematic illustration of mooring line 111 extending from platform 101, with mooring line portion 111A extending thru the ocean, with mooring line portion 111B and anchor 129 buried in ocean bottom 105, with lifting line 122 extending from anchor handling vessel 125 and connected to mooring line 111 via PCC lead line 128 and horse collar 127.

Figure 3:
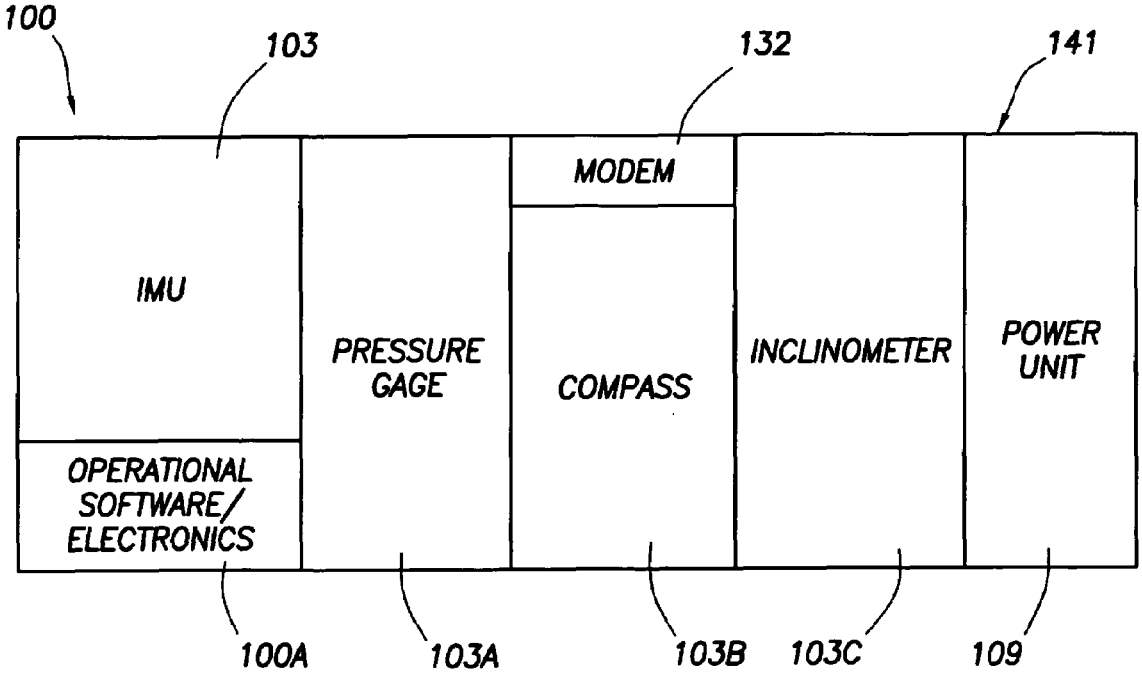
FIG. 3, is a schematic representation of apparatus 100 of the present invention, showing IMU unit 103, pressure gage 103A, compass 103B, inclinometer 103C, and modem 132.

Referring now to FIG. 3, there is shown a schematic representation of apparatus 100 of the present invention, showing IMU unit 103, pressure gage 103A, compass 103B, inclinometer 103C, and modem 132. It should be understood that unit 100 may further includes a power unit 109, and any other software and hardware 100A necessary to make it operational as is known to those of skill in the electronics art.

In the present invention, the initial location of mooring line 111 is established at the surface with a GPS ("Global Positioning System") fix and communicated to the subsea unit with its Inertial Navigation System ("INS")/Inertial Reference System ("IRS") unit 103. Another acronym associated with INS/IRS, is "IMU" (Inertial Measurement Unit). For brevity and consistency, IMU will be used in this specification, but would also implicitly include the subtle distinctions inherent with INS and IRS. The inventive apparatus 100 then tracks along mooring line 111 (generally a composite wire rope and chain) by attachment to horse collar 127 or to PCC cable 128. While moving along mooring line 111, the unit 100 monitors the location by double integration with respect to time of the inertial accelerations measured by IMU 103.

As an IMU head unit 103 can be prone to drift over time, which would create measurement errors in the position coordinates, the present invention provides that the electronic signal from IMU 103 can be calibrated, correlated, or corrected by comparison with signals from other data sources.

Such correction can be accomplished by knowing the depth of unit 100, its position relative to magnetic north, and its deviation from vertical. Thus, the present invention also includes a correction measurement device to obtain one or more of those necessary readings. While any suitable instruments can be utilized as the correction measurement device, in this embodiment, the preferred instruments for drift compensation can include an electronic pressure gage 103A, an electronic compass 103B, an inclinometer 103C, or any combination thereof.

Electronic pressure gage 103A can be implemented to provide depth correction by measuring hydrostatic pressures, and then calculating the depth based on the pressures. Electronic compass 103B would provide accurate reference to magnetic north. Electronic inclinometer 103C would provide a correction signal to IMU 103 by measuring absolute deviation from vertical.

The present invention may also include an error correction module in communication with the correction measurement device, which module will generate the error correction for the position coordinates of the apparatus at a second point on the line. This module may be a stand-alone device or may be incorporated into and/or integral to the present invention. This module may be hardware, software or any combination thereof.

The signal from IMU 103 is captured within onboard electronics, double integrated, and the path or trajectory of mooring line 111 is stored onboard the apparatus 100. This signal and its double-integrated results would be continuously compared to the signals from the correction/correlation devices incorporated into subsea unit 100. The corrected, double-integrated signal of the track can then be continuously transmitted to the surface through any suitable mechanism, including wireless transmission, acoustic modem, thru the mooring line, or thru wires in/on the mooring line. In the embodiment as illustrated, acoustic modem 132 may be used to generate acoustic data transmission waves 133. However, for continuous transmission on the cable location, acoustic modem 132 should have exceptionally fast data transmission rate and many subsea acoustic modems do not have the data-transmission or bandwidth capacity to accommodate continuous data transmission. To compensate for the lack of data-transmission capacity, the onboard electronics can be programmed to double integrate the inertial signal from the IMU unit. When the apparatus 100 has traveled a predetermined or prescribed incremental distance determined through the double integration, then the onboard electronics can order the acoustic modem 132 to transmit the current coordinates of the subsea unit. Theoretically, any suitable coordinate system can be utilized, a non-limiting example of which include a traditional "x-y-z" coordinate system. In this preferred embodiment, the coordinate system will be compatible with the industry-standard surveying software and coordinate systems.

The entire apparatus 100, comprising the IMU unit 103, signal-correction/compensation devices 103A, 103B and 103C, onboard electronics/software 100A, acoustic transponder/modem 132, and replaceable/rechargeable power unit 109, such as a battery pack, shall be housed in a casing 141 that is resistant to the expected hydrostatic pressures for the required application. Casing 141 could be attached to an anchor/cable chaser line, towed along mooring line 111 by the cable chaser, and ruggedized to withstand the hydrostatic pressures and the abuse of towing through or along the seafloor and subsea soils, and its retrieval onboard the anchor-handling vessel.

In addition, since IMU head units 103 can track inclination angles or can be integrated with electronic inclinometers, then the integrated subsea unit 100, comprising of all the components, can be located a known distance along the PCC cable. The horse collar 127 on PCC cable 128 will then track through the mud and along mooring line 111, but the unit 100 and its casing 141, attached to PCC cable 128 would not be directly subjected to the abuse of transiting through the mud. With unit 100 keeping track of its location and monitoring the inclination angles and the operators having positioned and clamped unit 100 at a known distance along PCC cable 128, then through simple trigonometric relations, the x, y, and z coordinates of horse collar 127 and cable chaser 128 can be calculated.

Further, by locating the IMU unit 100 a distance from the end of the PCC cable 128, then unit would only have to absorb shock loads from horse collar 127 transiting along the mooring chain 111 and through the seafloor soils 105.

Further, having general knowledge of the size and shape of the chain links in the mooring line 111, the subsea unit 100 could be attached to the PCC cable 128 with a suspension system 129. Said suspension system may comprise a linear spring, a damping system, and sufficient travel or stroke distance of the spring to accommodate displacement of the horse collar 127 as it bounces along the mooring chain 111.

The subsea unit 100 may transmit its signal 133 through an acoustic modem 132 to the surface, where the transmitted data may be received and analyzed. The transmitted data may be received from a standard acoustic transceiver 143 and sent to a monitoring computer 145, for example with a cable.

Computer 145 may receive the data, assess and calibrate data, and transmit the verified coordinates to an industry-standard surveying software, whereby data of the known locations of seafloor equipment, wellheads, pipelines, pipeline crossings, any possible manmade and/or natural hazzards, etc., can be compared with the data of the mooring locations. Possible interferences can then be identified and corrective action can be prescribed.

While the present invention has been illustrated mainly by reference to an offshore drilling apparatus, the invention has the utility and flexibility to work with any type of aquatic objects, whereby there is a need to monitor lines and the like which may extend from the object. In addition to drilling apparatus, non-limiting examples of aquatic objects include caissons, ships, submarines, barges, tugs, piers, wharfs, landings, rigs, platforms, buoys, and floating markers. A prominent non-limiting example of a marine vessel that requires accurate knowledge of its mooring lines is an offshore pipelaying barge.

While the present invention has been illustrated mainly by reference to mooring lines extending from an aquatic object, it should be understand that any lines extending from the object may be monitored by the present invention.

While the illustrative embodiments of the invention have been described with particularity, it will be understood that various other modifications will be apparent to and can be readily made by those skilled in the art without departing from the spirit and scope of the invention. Accordingly, the scope of the claims appended hereto is not intended to be limited to the examples and descriptions set forth herein but rather that the claims be construed as encompassing all the features of patentable novelty which reside in the present invention, including all features which would be treated as equivalents thereof by those skilled in the art to which this invention pertains.

The invention claimed is:

1. A method for monitoring a line with a first end extending from a floating marine structure and the second end in a body of water, the method comprising:

positioning a monitoring device at a first point on the line;

determining X, Y, and Z position coordinates of the first point on the line;

moving a monitoring device along the line from the first point to a second point on the line; and determining X, Y, and Z position coordinates of the second point on the line.

2. The method of claim 1, wherein the determining of the position coordinates of the second point on the line comprises double integrating with respect to time of inertial accelerations measured by the device as it is moved from the first point to the second point.

3. The method of claim 1, wherein the determining of the position coordinates of the second point on the line further comprises:

determining at the second point, at least one of (1) the depth of the device at the second point, (2) the position of the device at the second point relative to magnetic north, and (3) the deviation of the device from vertical, to create an error correction for the position coordinates at the second point.

4. The method of claim 1, wherein the determining of the position coordinates of the second point on the line further comprises:

determining at the second point, (1) the depth of the device at the second point, (2) the position of the device at the second point relative to magnetic north, and (3) the deviation of the device from vertical, to create an error correction for the position coordinates at the second point.

5. A method for relocating a mooring line with a first end extending from a floating marine structure and the second end in a body of water, the method comprising:

(A) positioning a monitoring device at a first point on the line;

(B) determining X, Y, and Z position coordinates of the first point on the line;

(C) moving a monitoring device along the line from the first point to a second point on the line;

(D) determining X, Y, and Z position coordinates of the second point on the line; and (E) relocating the mooring line.

6. The method of claim 5, further comprising:

(F) repeating steps (A) through (E).

7. The method of claim 5, wherein in step (D) the determining of the position coordinates of the second point on the line comprises double integrating with respect to time of inertial accelerations measured by the device as it is moved from the first point to the second point.

8. The method of claim 5, wherein in step (D), the determining of the position coordinates of the second point on the line further comprises:

determining at the second point, at least one of (1) the depth of the device at the second point, (2) the position of the device at the second point relative to magnetic north, and (3) the deviation of the device from vertical, to create an error correction for the position coordinates at the second point.

9. The method of claim 5, wherein in step (D), the determining of the position coordinates of the second point on the line comprises:

determining at the second point, (1) the depth of the device at the second point, (2) the position of the device at the second point relative to magnetic north, and (3) the deviation of the device from vertical, to create an error correction for the position coordinates at the second point.

10. An apparatus for monitoring a line, the line comprising a first end extending from a floating marine structure and the second end in a body of water, the apparatus comprising:

a frame;

a communication system supported by the frame, and in communication with a global positioning system, providing position coordinates of the apparatus at a first point on the line;

an inertial navigation system supported by the frame, providing position coordinates of the apparatus at a second point on the line, by double integration with respect to time of inertial accelerations measured by the device as it is moved from the first point to the second point.

11. The apparatus of claim 10, further comprising:

a measurement correction device, comprising at least one device selected from the group of devices consisting of a pressure gauge providing apparatus depth, a compass providing apparatus position relative to magnetic north, and an inclinometer for providing apparatus deviation from vertical, wherein the measurement correction device is supported by the frame.

12. The apparatus of claim 11, further comprising:

an error correction module in communication with the measurement correction device, which generates an error correction for the position coordinates of the apparatus at a second point on the line.

13. The apparatus of claim 10 further comprising:

a pressure gauge providing apparatus depth, a compass providing apparatus position relative to magnetic north, and an inclinometer for providing apparatus deviation from vertical, wherein the gauge, compass and inclinometer are all supported by the frame.

14. The apparatus of claim 13, further comprising:

an error correction module in communication with the gauge, compass and inclinometer, which generates an error correction for the position coordinates of the apparatus at a second point on the line.

* * * * *